US011156039B2

(12) United States Patent
Porter

(10) Patent No.: US 11,156,039 B2
(45) Date of Patent: Oct. 26, 2021

(54) MECHANICAL SHUTTLE PIPE GRIPPER

(71) Applicant: The Charles Machine Works, Inc., Perry, OK (US)

(72) Inventor: Rick G. Porter, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 203 days.

(21) Appl. No.: 16/408,691

(22) Filed: May 10, 2019

(65) Prior Publication Data

US 2019/0345782 A1 Nov. 14, 2019

Related U.S. Application Data

(60) Provisional application No. 62/670,964, filed on May 14, 2018.

(51) Int. Cl.
*E21B 19/15* (2006.01)
*E21B 7/04* (2006.01)

(52) U.S. Cl.
CPC ..... *E21B 19/15* (2013.01); *E21B 7/046* (2013.01)

(58) Field of Classification Search
CPC ..... E21B 19/15; E21B 19/16; E21B 7/046; E21B 7/02
See application file for complete search history.

(56) References Cited

U.S. PATENT DOCUMENTS 6,179,065 B1 1/2001 Payne et al.
6,332,502 B1 12/2001 Mills et al.
6,360,830 B1 3/2002 Price
6,533,046 B2 * 3/2003 Mills ..... E21B 19/14 175/52
7,018,164 B2 * 3/2006 Anthis ..... E21B 19/15 221/95
7,240,742 B2 7/2007 Sewell et al.
7,467,670 B2 * 12/2008 Hartke ..... E21B 19/14 175/52
7,544,036 B1 6/2009 Randall et al.
(Continued)

FOREIGN PATENT DOCUMENTS

WO 2007041822 A1 4/2007

OTHER PUBLICATIONS

Korean Intellectual Property Office, "PCT International Search Report" dated Nov. 17, 2015, 3 pages, Republic of Korea.
(Continued)

*Primary Examiner* — Michael R Wills, III
(74) *Attorney, Agent, or Firm* — Tomlinson McKinstry, P.C.

(57) ABSTRACT

A pipe shuttle for moving a pipe segment from an operating position to a pipe box. The pipe shuttle has a pair of gripper arms flanking a cradle. The cradle has a spring-loaded pad that has a concave surface for holding a pipe segment. As the pipe shuttle moves from underneath a pipe box to near a cradle, rollers are positioned to engage a guide plate. When the shuttle is underneath the pipe box, the rollers engage the guide plate to keep the cradle open. When moved towards an operating position, the rollers no longer engage the guide plate and cause grippers to close on the pipe segment. The spring-loaded pad allows the pipe shuttle to be moved relative to the pipe segment when the pipe segment is in its operating position.

24 Claims, 14 Drawing Sheets

(56) References Cited

U.S. PATENT DOCUMENTS

| | | | | |
|---|---|---|---|---|
| 7,600,584 | B2 | 10/2009 | Sewell et al. | |
| 7,694,751 | B2 * | 4/2010 | Hartke | E21B 7/046 175/52 |
| 9,127,518 | B1 | 9/2015 | Sewell | |
| 2001/0022238 | A1 | 9/2001 | Houwelingen et al. | |
| 2002/0153169 | A1 | 10/2002 | Sewell | |
| 2003/0196791 | A1 | 10/2003 | Dunn et al. | |
| 2005/0103526 | A1 | 5/2005 | Ayling | |
| 2007/0031215 | A1 | 2/2007 | Belik | |
| 2007/0119623 | A1 | 5/2007 | Sewell et al. | |
| 2007/0240903 | A1 | 10/2007 | Alft et al. | |
| 2009/0095526 | A1 | 4/2009 | Lane et al. | |
| 2013/0240269 | A1 | 9/2013 | Novelo et al. | |
| 2017/0159379 | A1 * | 6/2017 | Metcalf | E21B 7/02 |
| 2017/0370149 | A1 * | 12/2017 | Sevits | E02F 5/16 |

OTHER PUBLICATIONS

The Charles Machine Works, Inc., "Ditch Witch Shuttle Stop—Ends with S/N: DWPJT40XPH000015", pages from company manual, undated, 3 pages, Perry, Oklahoma.

The Charles Machine Works, Inc., "Pipe Loader Shuttle", pages from company manual, undated, 2 pages, Perry, Oklahoma.

The Charles Machine Works, Inc., "Pipe Shuttle", pages from company manual, undated, 4 pages, Perry, Oklahoma.

The Charles Machine Works, Inc., "Shuttle Drive", pages from company manual, undated, 3 pages, Perry, Oklahoma.

* cited by examiner

MECHANICAL SHUTTLE PIPE GRIPPER

SUMMARY

The present invention is directed to a pipe shuttle. The pipe shuttle comprises a linear shuttle track, a shuttle body, a shuttle drive system, a gripper, and a cam-follower arrangement. The shuttle body is supported by the shuttle track and constrained to move therealong. The drive system is configured to power movement of the shuttle body. The gripper is rotatably supported by the shuttle body and conformable to a pipe. The cam-follower arrangement is capable of causing rotation of the gripper in response to linear motion of the shuttle body.

The present invention is also directed to a drilling machine. The drilling machine comprises a machine frame, a pipe box, a carriage, and a pipe shuttle. The pipe box is supported on the machine frame and contains a plurality of pipe sections. The carriage is movable along the machine frame in a first direction and connectable to each of the plurality of pipe sections. The pipe shuttle comprises a guide plate, a support frame, and a gripper. The guide plate is fixed in position relative to the machine frame. The support frame is supported by the guide plate and movable relative thereto in a second direction. The gripper is disposed on the support frame. The gripper is engageable with the guide plate. The gripper is movable between an open position and a closed position, and configured to conform to a pipe section held by the support frame when in the closed position. The gripper is maintained in the open position when the gripper engages the guide plate.

DETAILED DESCRIPTION

Many utility pipelines are installed underground by boring a borehole in a generally-horizontal direction rather than by digging a trench. This type of construction is typically referred to as "horizontal boring" or "horizontal directional drilling" ("HDD"). A horizontal borehole is created by using a drilling machine to drive rotation of a drill bit attached to a drill string. The drill string is made of up of a plurality of pipe sections connected together. The pipe sections are stacked in columns within a pipe box attached to the drilling machine. A carriage included within the drilling machine connects the pipe sections together and pushes or pulls the drill string through the ground surface.

In operation, a pipe handling assembly uses a pair of shuttle arms to transport each pipe section between the pipe box and the carriage. The shuttle arms are stopped beneath each column using a pipe column selection assembly.

Shuttle arms often comprise an open socket or a catchment for supporting a pipe section as it is moved from beneath a pipe box to the carriage. Securing the pipe section so that sudden stops or jolts do not dislodge them from the shuttle arms is advantageous. In addition, the precise location of a pipe section in the shuttle arm enables faster and better pairing of the pipe section to the carriage and the drill string.

Figure 1:
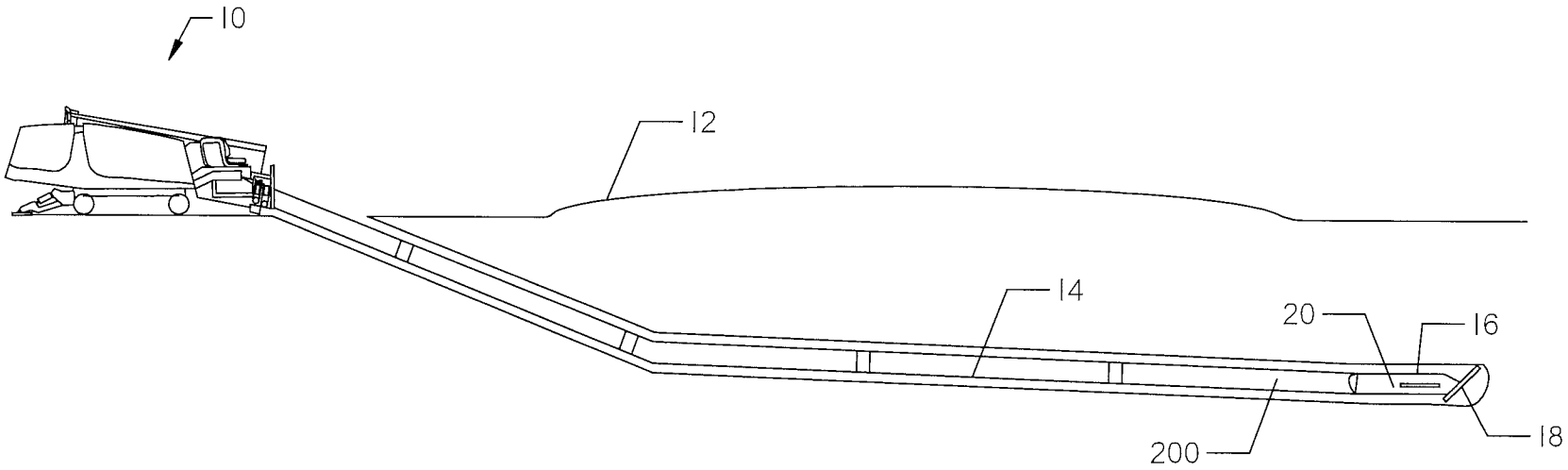
FIG. 1 is an illustration of a horizontal boring operation

With reference now to the figures, FIG. 1 shows a drilling machine 10 sitting on a ground surface 12. Extending from the drilling machine 10 is a drill string 14. The drill string 14 is made up of a plurality of pipe sections 200 attached end to end. The drill string 14 is connected to a downhole tool 16 at its first end and the drilling machine 10 at its second end.

The downhole tool 16 comprises a drill bit 18 and a beacon contained within a beacon housing 20. An above ground operator uses a tracking device (not shown) to confirm the location of the beacon housing 20 underground.

In operation, the drill string 14 is rotated by the drilling machine 10, causing the drill bit 18 to displace underground material and create a borehole. The drilling machine 10 adds pipe sections 200 to the drill string 14 as the downhole tool 16 advances underground.

Figure 2:
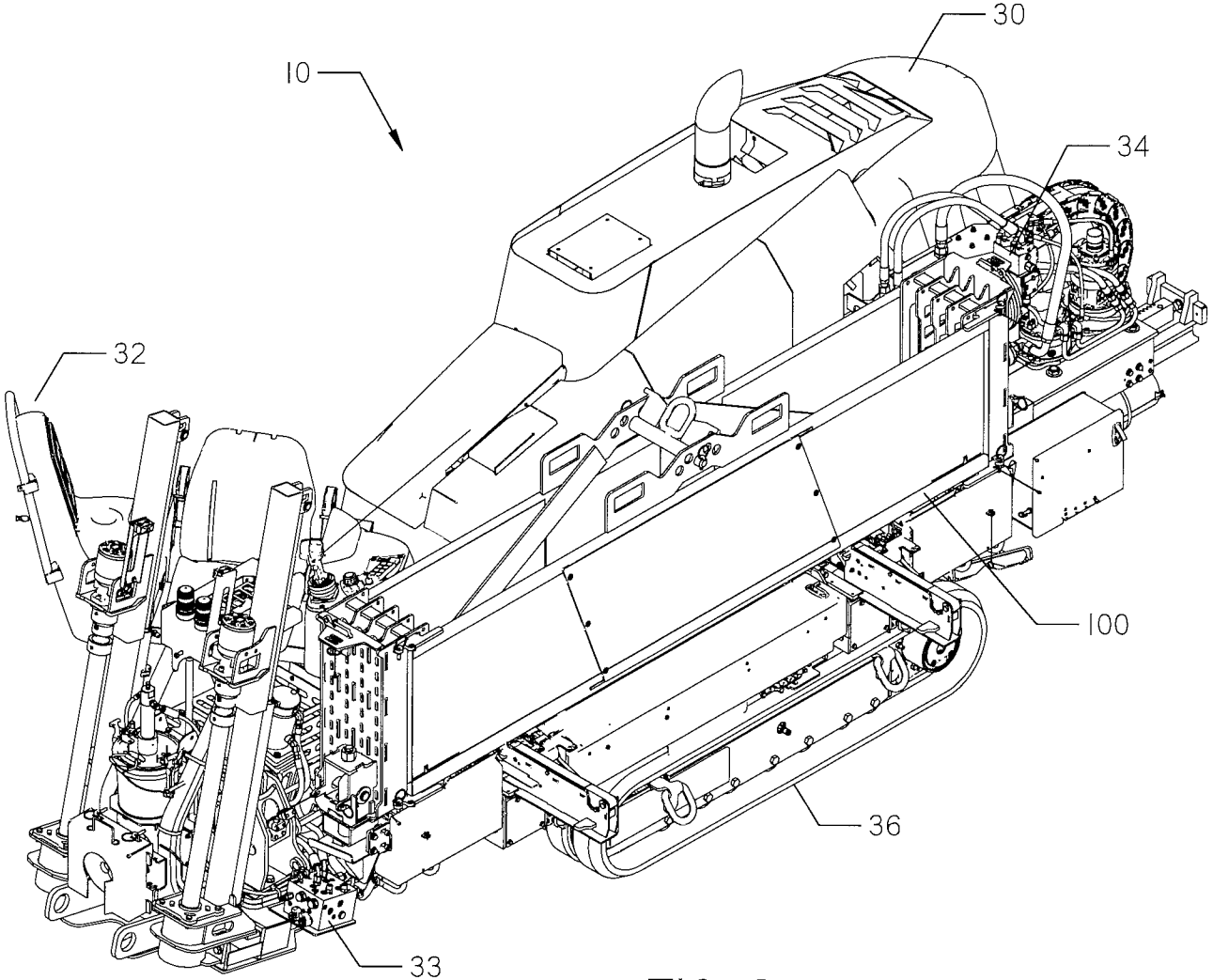
FIG. 2 is a perspective view of a horizontal boring machine of the present invention.

As shown in FIG. 2, the drilling machine 10 comprises an engine housed within an engine cowl 30, an operator station 32, a pipe handling assembly 100, a wrench assembly 33 and a carriage 34. The components of drilling machine 10 are supported on a frame that is in turn supported on a pair of endless tracks 36. The tracks 36 move the machine 10 from location to location.

The carriage 34 connects pipe sections 200 to or removes pipe sections 200 from the drill string 14 (FIG. 1). The wrench assembly 33 provides torque to this connection or removal process, and may hold the drill string 14 while a new pipe section is threaded by the carriage 34. The carriage 34 also moves back and forth along the frame to push and pull the drill string through the ground. The carriage 34 moves along the frame of the drilling machine 10 in a first direction to provide thrust to the drill string 14 and to return to its starting location for connection to a new drill section 200.

The present invention is directed to a pipe handling assembly 100 that provides for reliable transfer of pipe into and out of the carriage 34 using a mechanical cam-follower arrangement rather than hydraulics.

Figure 3:
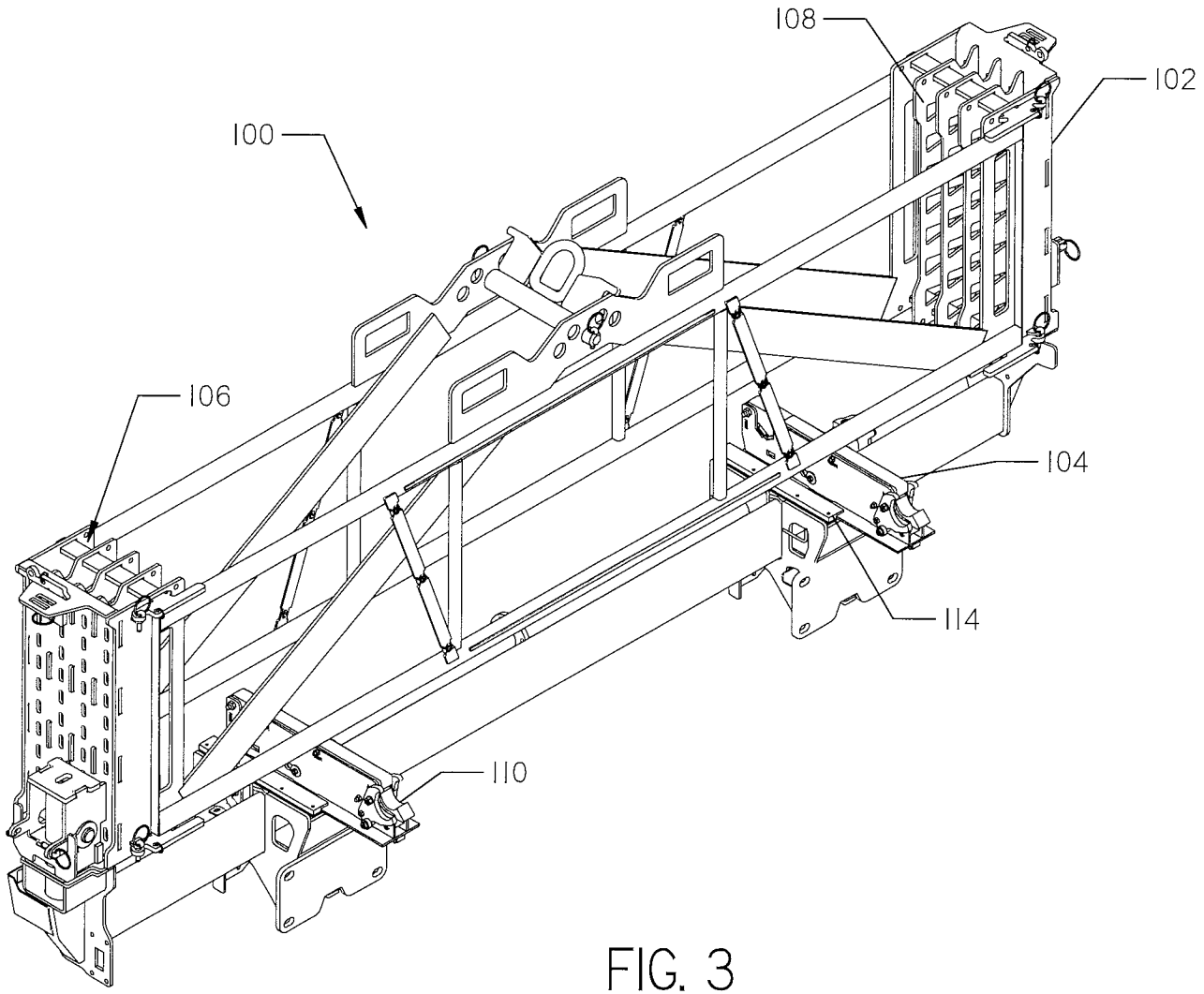
FIG. 3 is a perspective view of a pipe handling assembly removed from the horizontal boring machine of FIG. 2. The shuttle arms are shown in the operating position.
Figure 10:
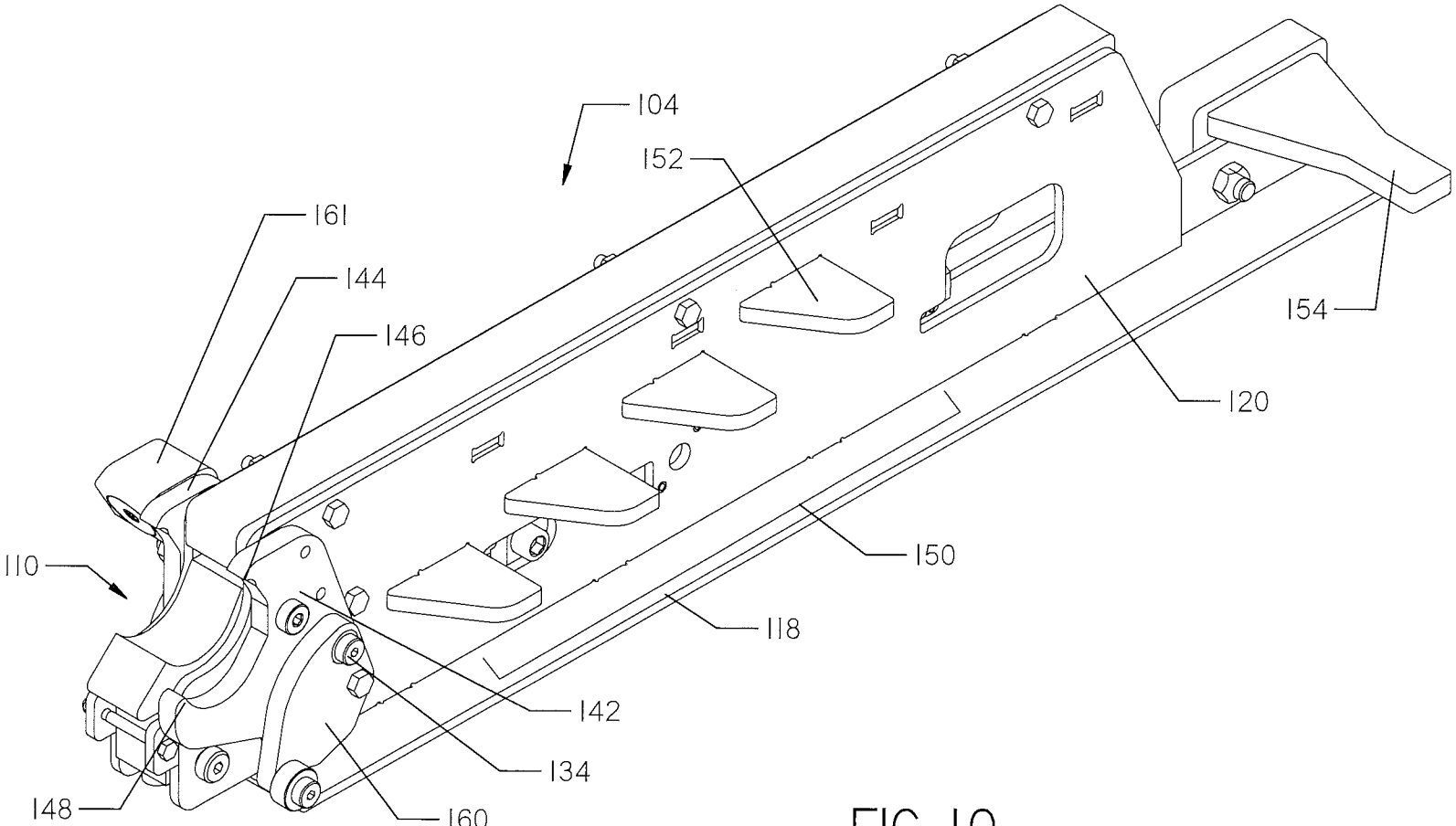
FIG. 10 is a top right perspective view of an embodiment of a shuttle arm.

With reference to FIGS. 2-3, a pipe handling assembly 100 stores the pipe segments 200 and provides a mechanism for moving stored pipe sections in a second direction along the frame of the drilling machine 10 for connection to the drill string 14. The pipe handling assembly 100 comprises a pipe box 102, a pair of shuttle arms 104, and a pipe column stop assembly 150 (FIG. 10). The pipe box 102 contains four columns 106 for storing pipe sections 200. The columns 106 are created by dividers 108 formed at opposite ends inside the pipe box 102. The shuttle arms 104 are positioned such that they are parallel to and spaced apart from one another on the frame underneath the pipe box 102.

In operation, the shuttle arms 104 retrieve pipe sections from each of the columns 106 and deliver the pipe sections to the carriage 34 (FIG. 2) to be added to the drill string 14 (FIG. 1). If a drill string is being removed from the borehole, the shuttle arms 104 will remove pipe sections from the carriage 34 and return the pipe sections to the pipe box 102. The pipe sections are held in a cradle 110 formed at the end of each of the arms 104.

With reference to FIGS. 3-9B, the shuttle arms 104 are moved using a drive system, such as a rack and pinion gear. The rack 112 is secured to a bottom of each of the shuttle arms 104 and has a forward and rearward end. Each rack 112 mates with a corresponding pinion gear (not shown) mounted on the frame via brackets. The rotating pinion gears engage the racks causing the shuttle arms 104 to move back and forth on the frame. Other means for translating the shuttle arms 104 may include a linear actuator like a hydraulic cylinder or jackscrew.

Figure 4:
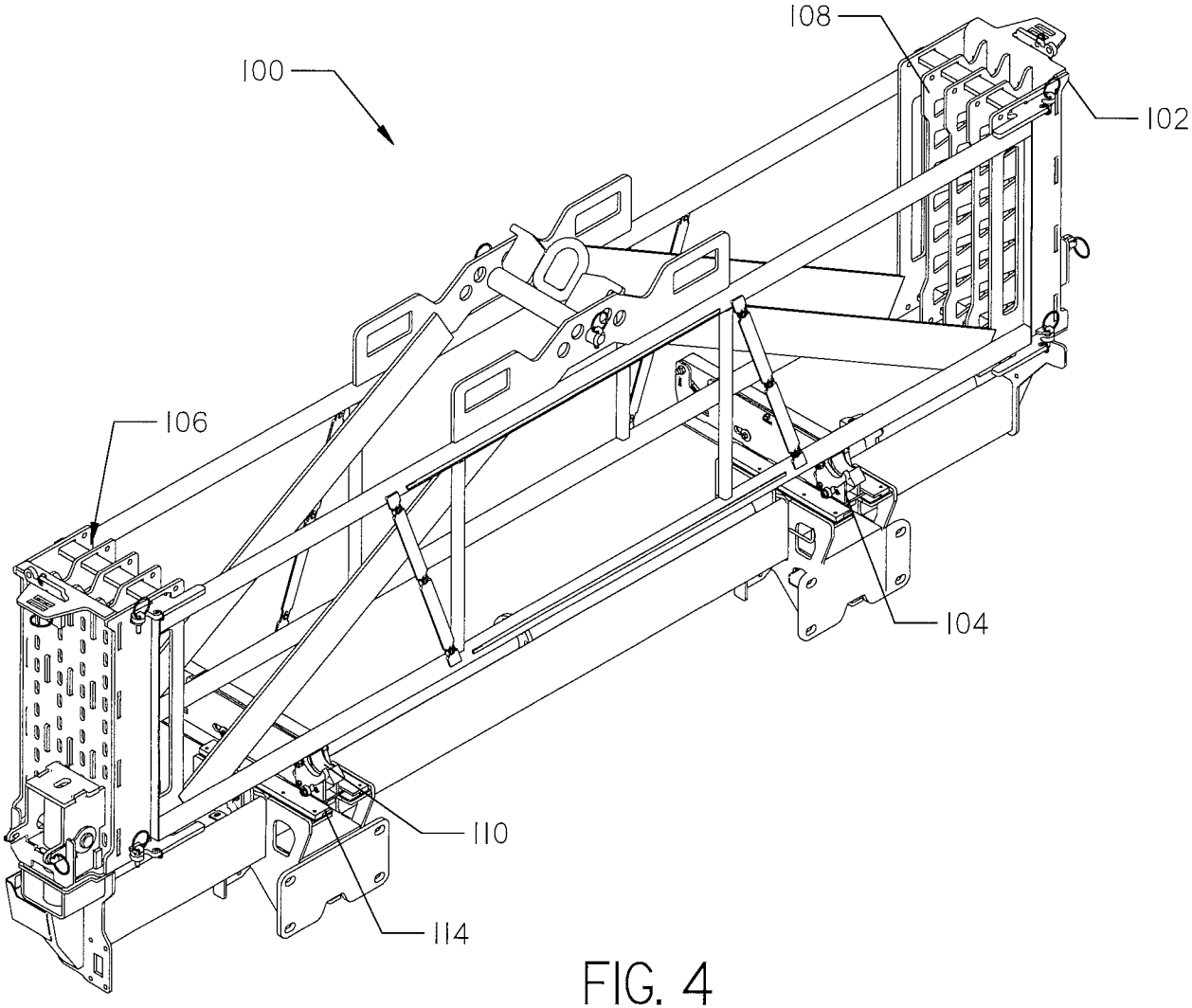
FIG. 4 is a perspective view of the pipe handling assembly of FIG. 3. The shuttle arms are shown under a pipe box column.
Figure 5:
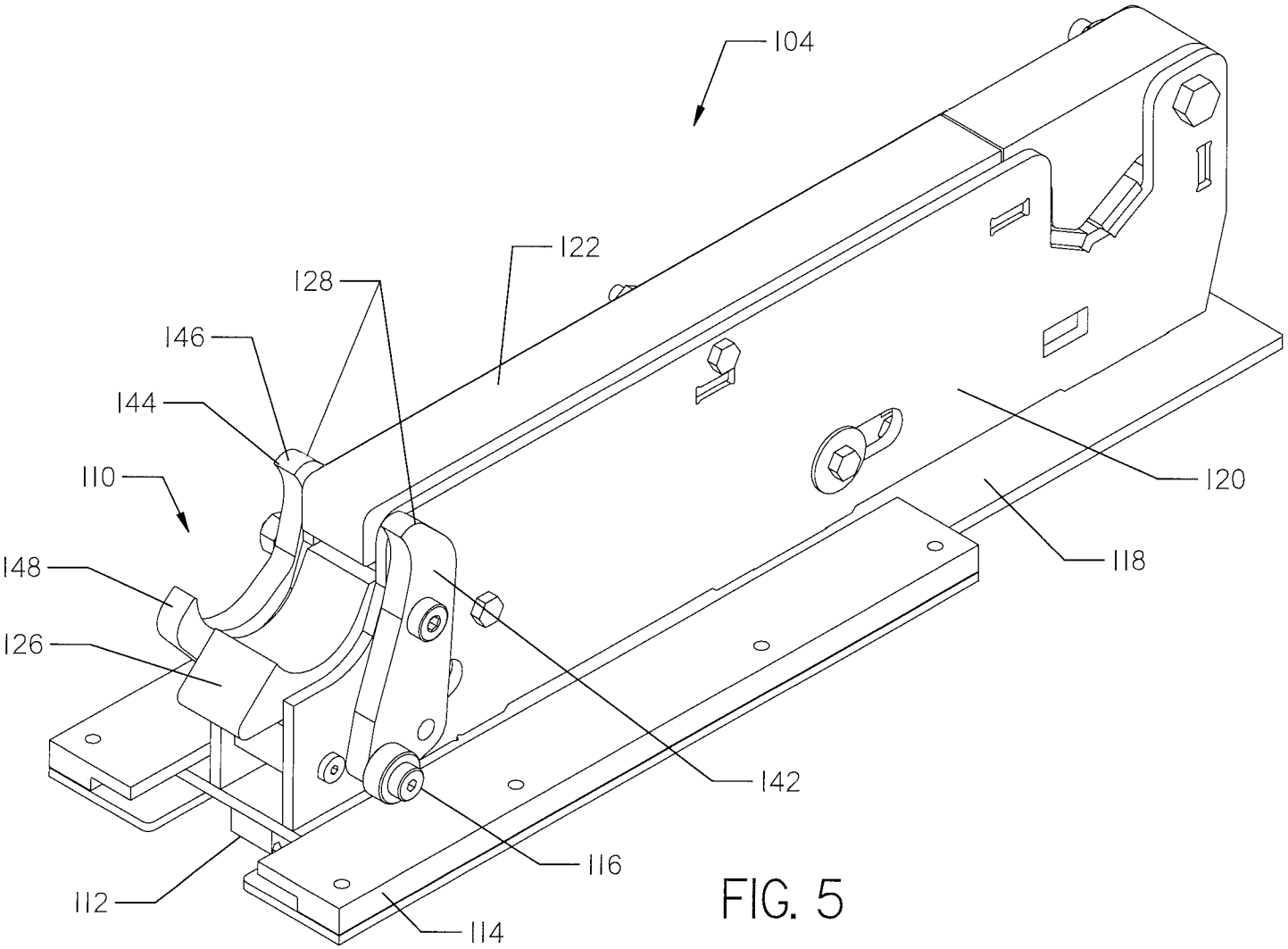
FIG. 5 is a perspective view of a shuttle arm of the pipe handling assembly of FIG. 3. The cradle is shown in the open position.
Figure 6A:
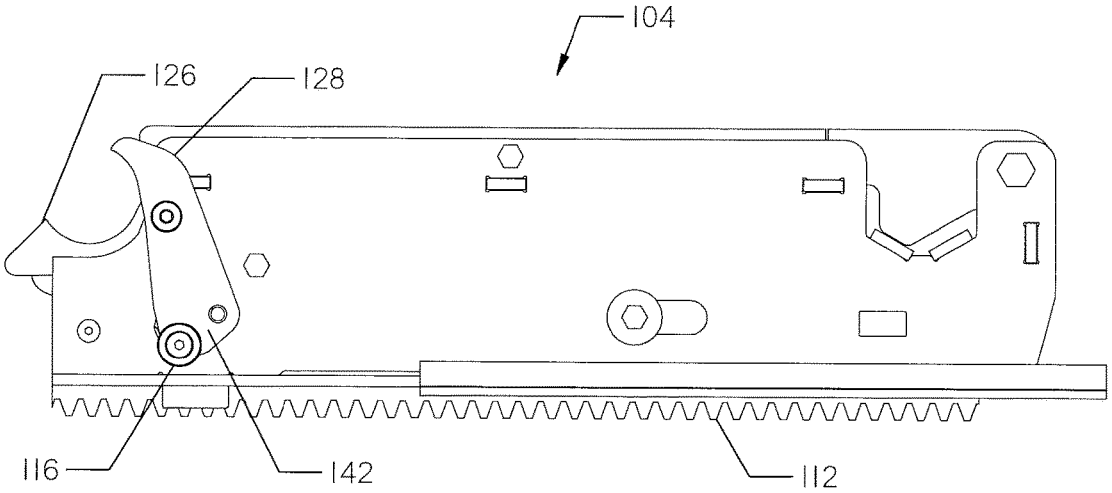
FIG. 6A is a first side view of the shuttle arm of FIG. 5. The cradle is shown in the closed position.
Figure 6B:
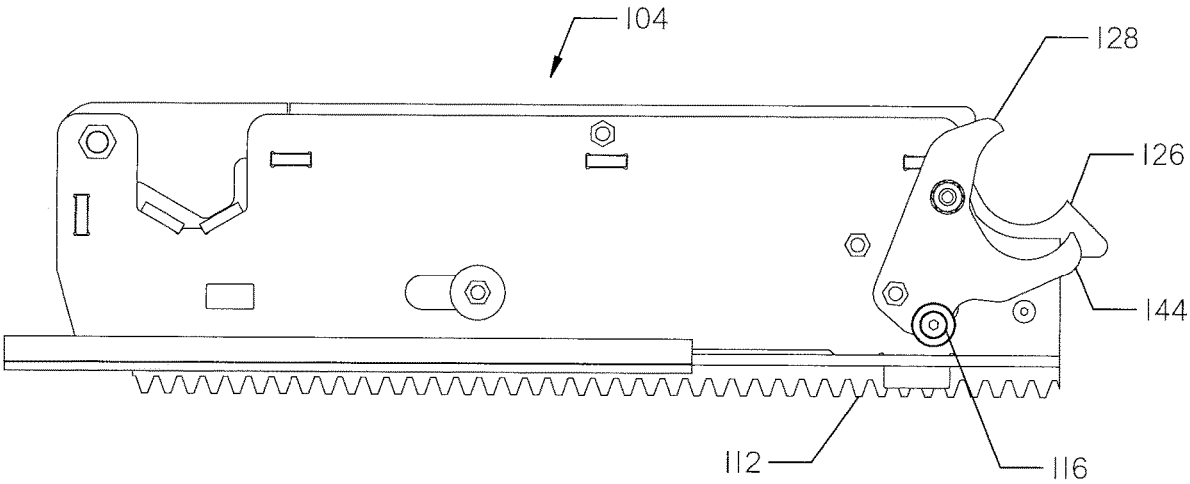
FIG. 6B is a second side view of the shuttle arm of FIG. 5. The cradle is shown in the closed position.
Figure 7A:
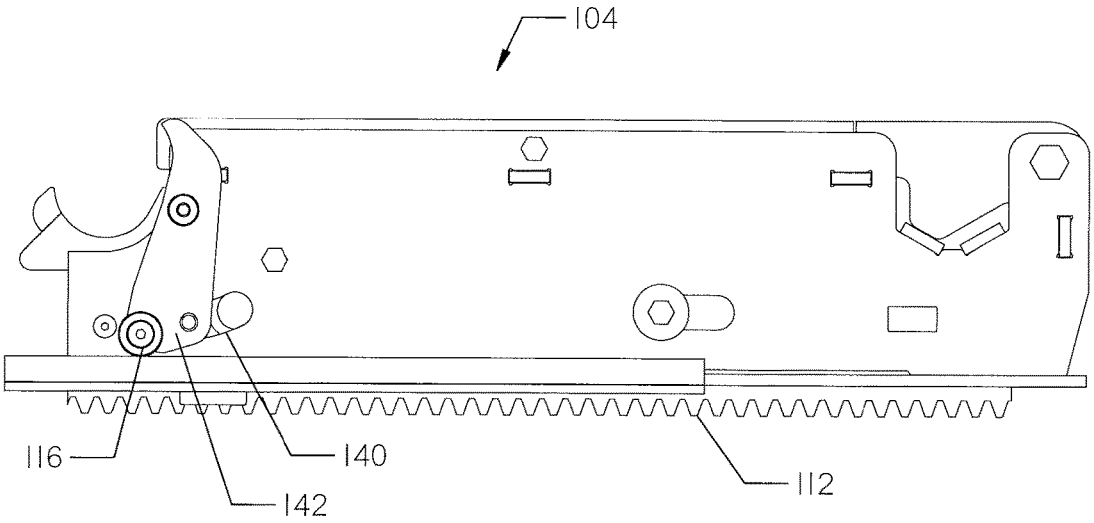
FIG. 7A is a first side view of the shuttle arm of FIG. 5. The cradle is shown in the open position.
Figure 7B:
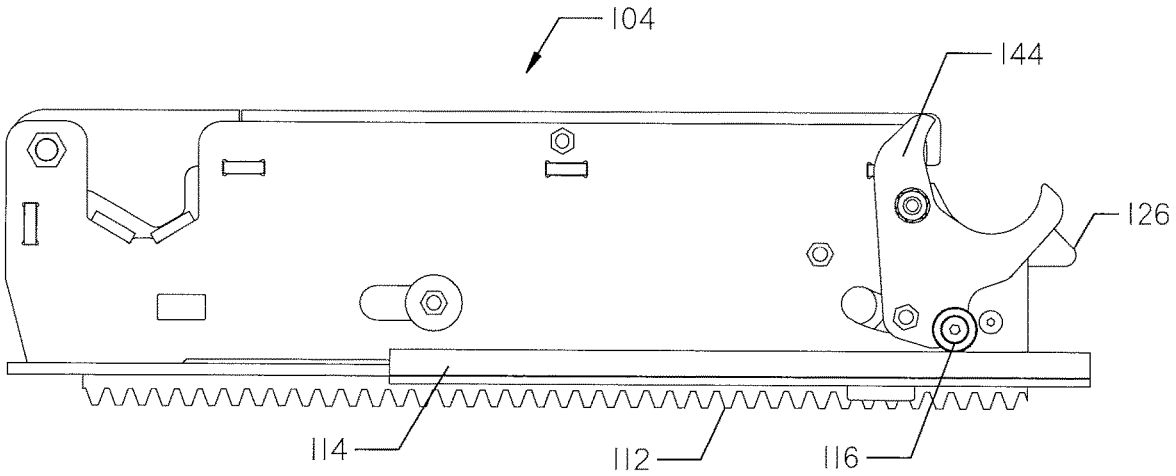
FIG. 7B is a second side view of the shuttle arm of FIG. 5. The cradle is shown in the open position.

The shuttle arms 104 move between guides 114 mounted to the frame and brackets. The shuttle arm 104 is mounted between guides 114 in which it may move longitudinally via the rack 112 and pinion. The shuttle arms 104 in FIG. 3 are shown in the operating position. In the operating position the cradle 110 is closed, such that a pipe section 200 is secured inside. As the shuttle arms 104 move away from the carriage 34 and towards the pipe box 102 the cradle 110 is opened through a pair of rollers 116 which engage the guide 114. The rollers 116 allow the cradle 110 to open and the shuttle arm 104 is positioned underneath one of four columns 106 (FIG. 4). The shuttle arms 104 may then either return or retrieve a pipe section from the column 106 while the cradle 110 is in the open position.

The shuttle arm 104 comprises the cradle 110, a bottom plate 118, a pair of side plates 120, and the rack 112 and a top plate 122. The bottom plate 118, side plates 120 and top plate 122 generally form a support frame for supporting the cradle and allowing the movement relative to the drilling machine. The bottom plate 118 is situated within a slot in the guide 114 (FIG. 14) and allows for single-axis movement of the shuttle arm 104 in the second direction along this linear track. Preferably, the second direction is transverse to the first direction.

The cradle 110 comprises a pad 126, a pair of grippers 128, the rollers 116, a compression spring 130, and an extension spring 132. The extension spring 132 (FIGS. 8A-8B) biases the grippers 128 in a closed position by maintaining pressure on a bushing 134 that is attached to the lower end of each of the grippers 128. The tension on the extension spring 132 may be adjusted with a tensioner 138. Tension is primarily adjusted during assembly. As shown, the tensioner 138 is a screw for adjusting the distance between the ends of the extension spring 132. While the grippers 128 are in the closed position, the cradle 110 is closed such that pipe sections cannot be added or removed from the pipe box.

Figure 8A:
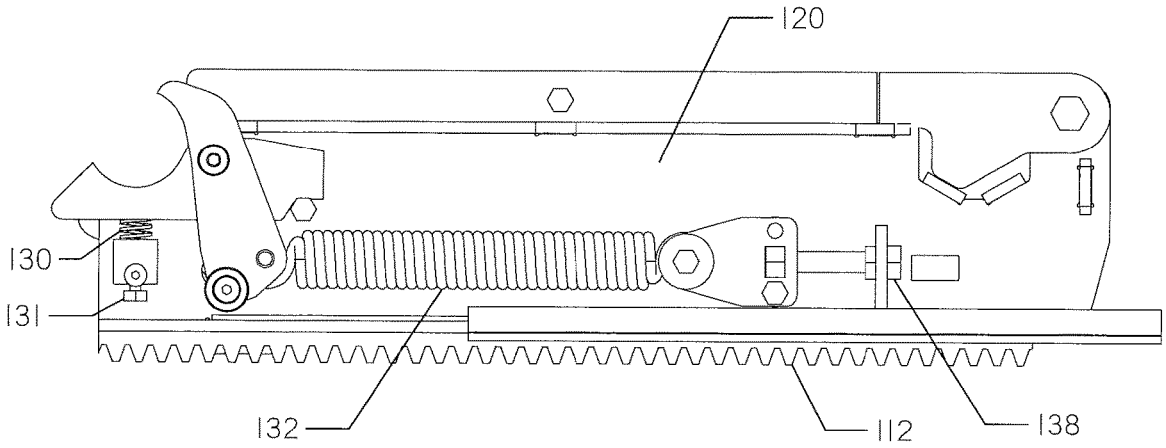
FIG. 8A is the first side view of the shuttle arm of FIG. 5 with the side plate removed.
Figure 8B:
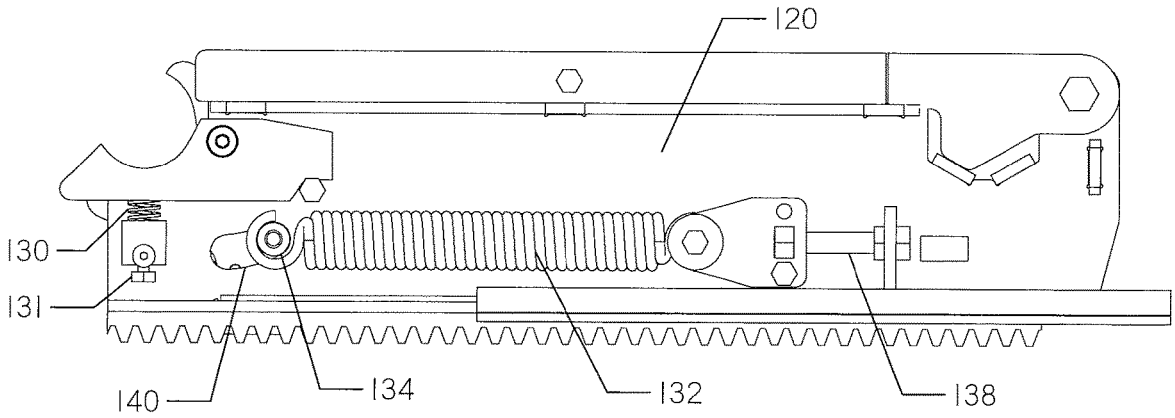
FIG. 8B is a cross-sectional view of the first side view of the shuttle arm of FIG. 5.
Figure 9A:
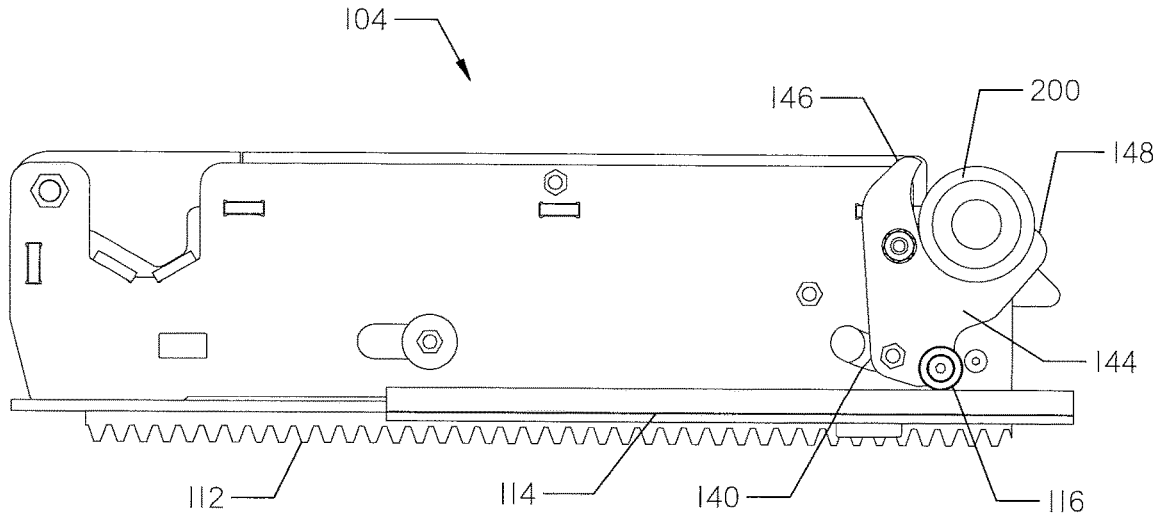
FIG. 9A is the second side view of the shuttle arm of FIG. 5 with a pipe held in the cradle. The cradle is shown in the open position.
Figure 9B:
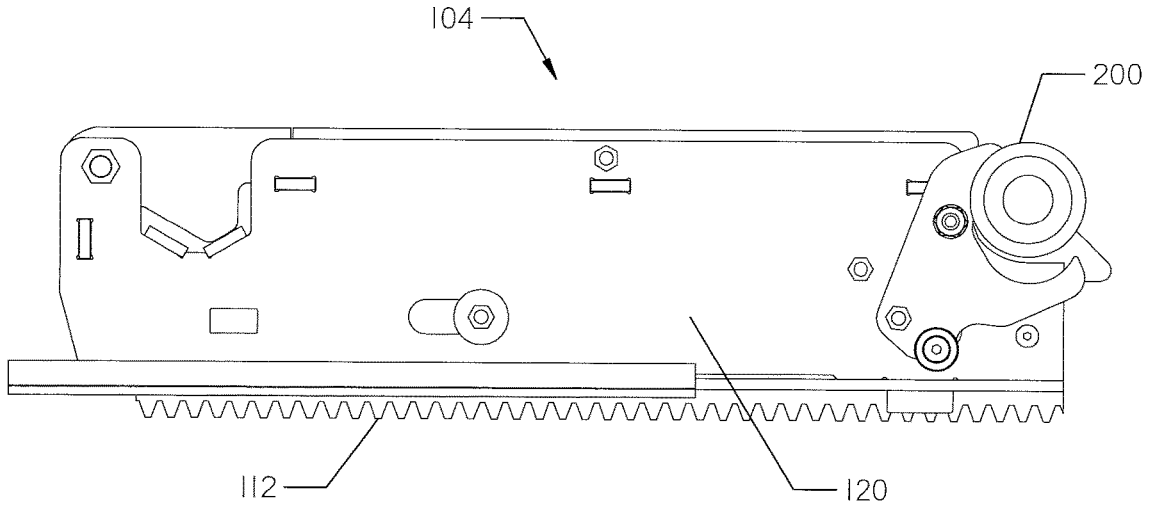
FIG. 9B is the second side view of the shuttle arm of FIG. 5 with a pipe held in the cradle. The cradle is shown in the closed position.

The bushing 134 is situated between a first set of slots 140 in the side plates 120. (FIGS. 8A-8B). The grippers 128 rotate between an open and closed position as the bushing 134 slides back and forth within the first set of slots 140 in a cam-follower arrangement. However, when the shuttle arm 104 is in an operating position such that a pipe segment 200 held within would be near the carriage 34, the cam-follower does not function. As a result, when the shuttle arm 104 is in the operating position the extension spring 132 holds the grippers 128 in the closed position. As the shuttle arm 104 moves under the pipe box 102 and the rollers 116 engage the guide 114, the extension spring 132 expands and the grippers 128 are pushed to the open position (FIGS. 7A-7B), opening the cradle 110.

After the shuttle arm 104 returns or retrieves a pipe section 200 (FIGS. 9A-9B) from the pipe box 102 the shuttle arm is reversed and moves back towards the operating position. When the rollers 116 disengage the guide 114 the extension spring 132 retracts and the grippers 128 move to the closed position. The cam-follower arrangement and extension spring 132 ensures that movement from the open position to the closed position only occurs when the shuttle arm 104 moves from the pipe box to the operating position. Likewise, movement from the closed position to the open position occurs only when the shuttle arm 104 is moved in the opposite linear direction, back towards the pipe box 102.

In the embodiment of FIGS. 5-9B, the grippers 128 include a first gripper 142 and a second gripper 144 situated on either side of the pad 126. Both grippers 142, 144 comprise an upper end 146 to hold the pipe between the gripper and the pad 126 when the gripper 128 is in the closed position. The second gripper 144, as shown, has a lower end 148 that serves as a retainer for a pipe section being returned or retrieved from the pipe box 102 while the cradle 110 is in the open position (FIG. 9A). In an alternative embodiment, both grippers 128 could comprise an upper 146 and lower end 148. Each gripper 128 is conformable to the pipe, and is in opposed relationship to the concave surface of the pad 126.

When the cradle 110 is in the closed position with a pipe section 200 held by the grippers 128, force is applied to the pipe section 200 by the pad 126. The pad 126 is attached to the side plates 120. The front side of the gripper pad 126 sits on the compression spring 130. The compression spring 130 exerts an upward force on the pad 126 and the pipe section 200 (FIGS. 8A-9B). The amount of tension on the compression spring 130 can be adjusted by turning the compression spring bolt 131.

When the shuttle arm 104 is in the operating position, the carriage 34 will connect a pipe section 200 to the drill string 14 or remove a pipe section from the drill string. As the carriage 34 connects a pipe section 200 to the drill string 14 the shuttle arm 104 will move away from the operating position. At this point, the pipe segment 200 is held fast by its connection to the drill string 14 and the carriage 34.

Figure 12A:
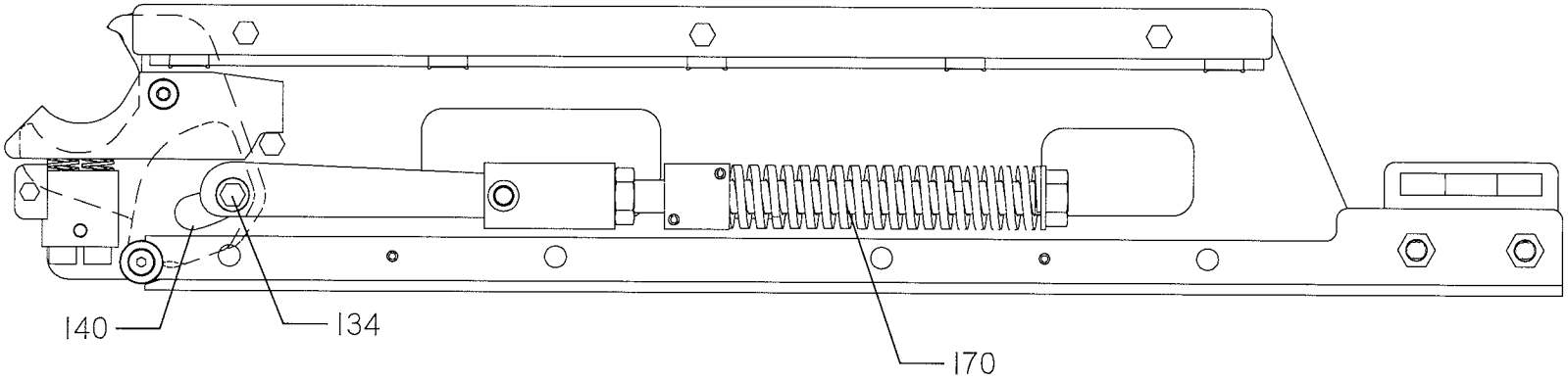
FIG. 12A is a side view of the shuttle arm of FIG. 10 with the cradle shown in the closed position and the side plate removed.
Figure 13A:
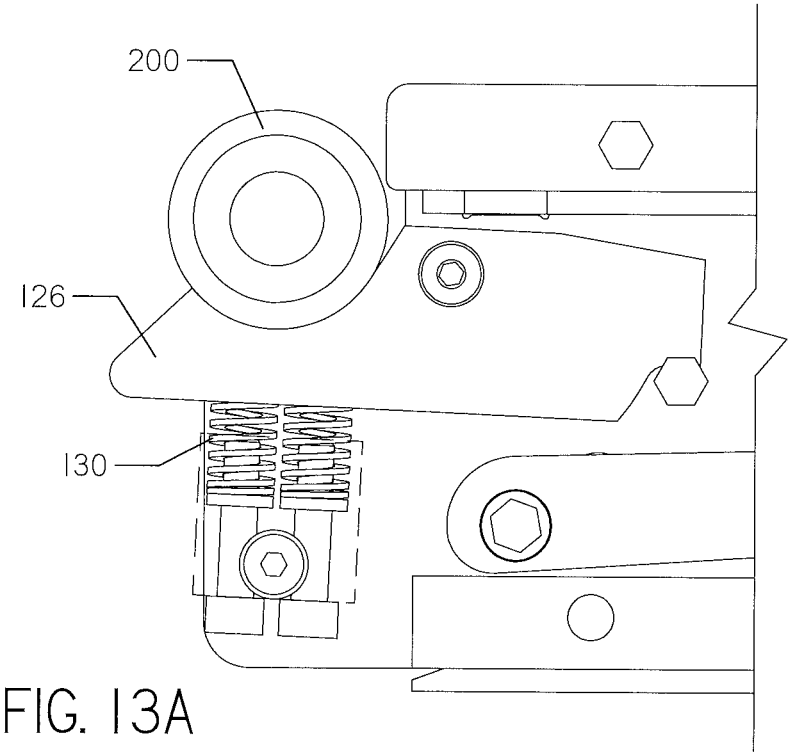
FIG. 13A is a detail side view of a pipe section being held within the cradle, showing the compression spring and spring block in phantom.
Figure 13B:
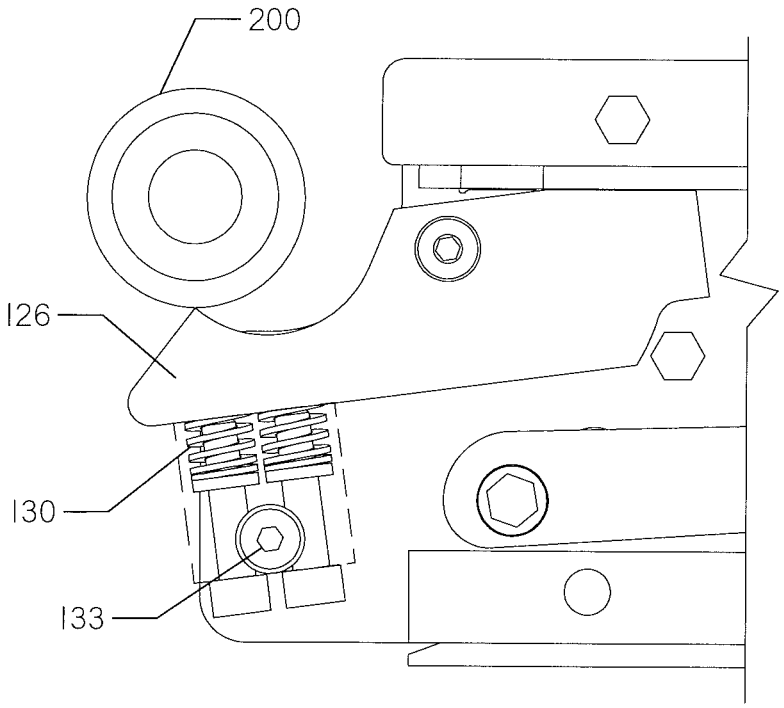
FIG. 13B is the detail view of FIG. 13A with the pipe section causing the compression springs and pad to tilt.
Figure 14:
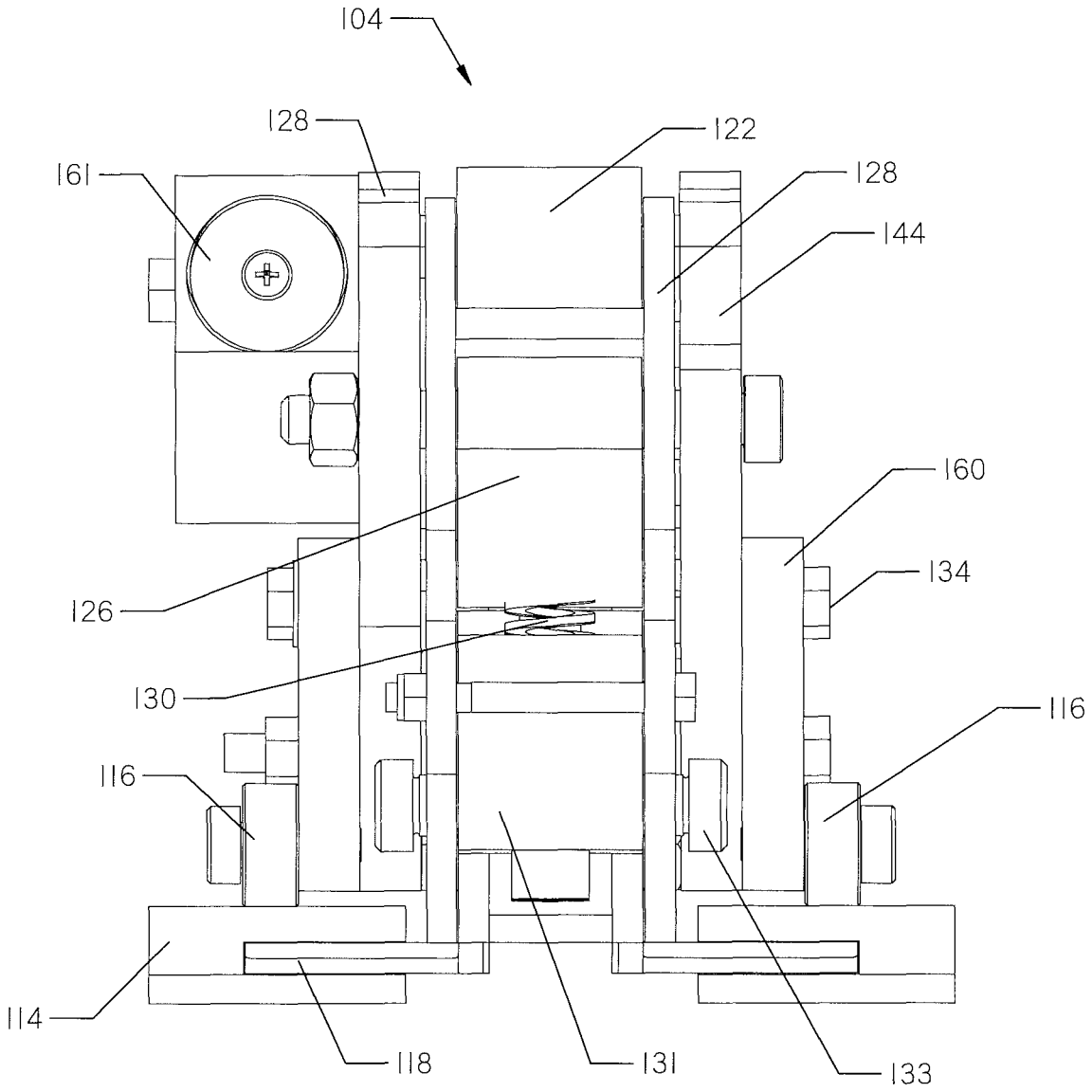
FIG. 14 is a front view of the shuttle arm of FIGS. 10-11.

With reference to FIGS. 13A-14, as the shuttle arm 104 moves away from the operating position, the pipe section 200 will force the pad 126 to press down on the compression spring 130. As shown in FIG. 13B, the pad will move down and around the pipe section 200 enough to allow the shuttle arm 104 to pull away from the pipe section. Likewise, when the shuttle arm 104 is moving towards the carriage 34 to retrieve a pipe section from the carriage, the gripper pad 126 will press down on the compression spring 130 under the force of the pipe section 200 enough to allow the cradle 110 to envelop the pipe section, as shown in FIG. 12A.

The compression spring 130 is attached to a spring block 131. The spring block 131 is pinned to the shuttle arm 104 and may tilt relative to it about a bolt 133. This range of movement allows the pad 126 to react to forces imparted by the pipe section 200.

With reference to FIG. 10, an embodiment of the shuttle arm 104 is shown. The shuttle arm 104 has a column stop assembly 150 comprising one stop 152 for each column 106 (FIG. 3). The stops 152 are disposed along the side wall 120. A column stop actuator (not shown) is provided on the drill frame. A stop bar is disposed on the rod end of the actuator. The actuator is configured to move the stop bar along a vertical axis so that the stop bar may intersect a selected stop 152. Each stop 152 corresponds to a matching column 106 when it intersects the stop bar and aids in location of the cradle 110 beneath the proper pipe column. A back stop 154 may be utilized to indicate that the shuttle is aligned with the spindle. Alternatively, a spring or cushioned stop 154 may be utilized to reduce jolting on the shuttle arm 104 when a pipe section is within the cradle 110.

Figure 11:
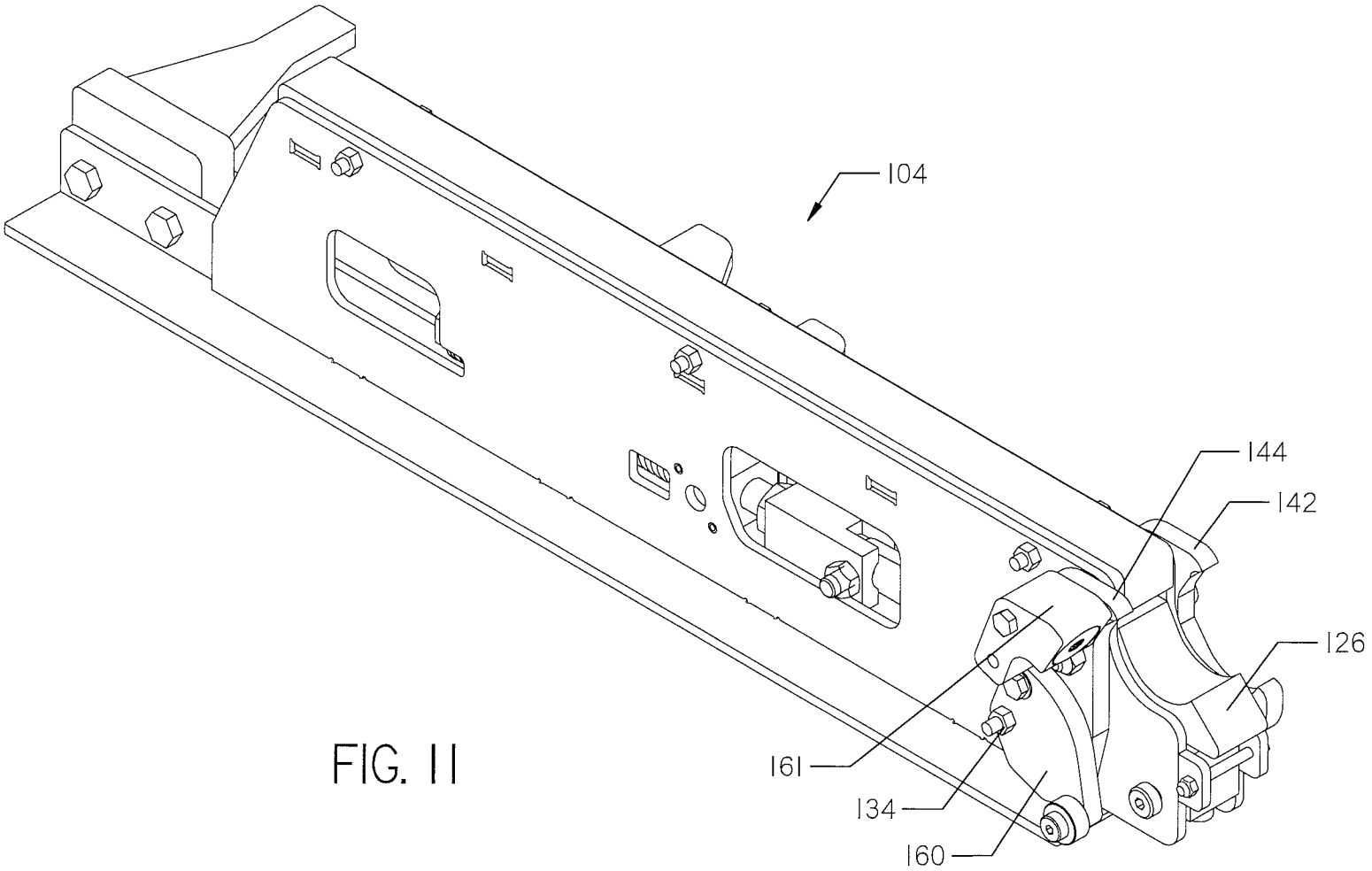
FIG. 11 is a top left perspective view of the shuttle arm of FIG. 10.

In FIGS. 10-11, the cradle 110 comprises a magnet 161 located near the second gripper 144 which may provide a magnetic grip on a pipe section 200. The magnet 161, used in conjunction with grippers 128, the concave surface of pad 126, and lower tong 148 provide for coaxial alignment of a pipe section 200 and the spindle 34.

In the embodiment of FIGS. 10-11, the grippers 128 may be attached to extension plates 160. The extension plates are then attached to rollers 116 to aid in the spacing of the grippers 128. As shown in FIG. 10, the first gripper 142 has both upper 146 and lower 148 ends.

Figure 12B:
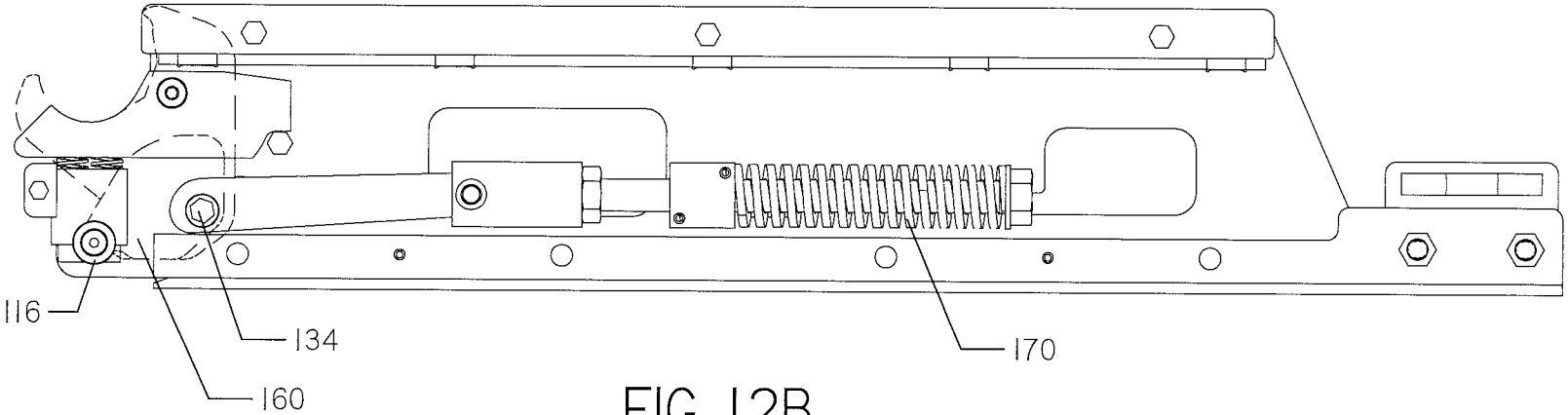
FIG. 12B is the view of FIG. 12A with the cradle shown in the open position.

With reference to FIGS. 12A-12B, the shuttle arm 104 utilizes a compression spring 170 rather than the extension spring 132 to bias the grippers 128 to the closed position. Because the bushing 134 is not co-axial with the roller 116 (as in FIGS. 3-9B), the grippers 128 are closed when the bushing 134 is at a furthest back position relative to the slot 140, as shown in FIG. 12A. When the rollers 116 engage the guide plate 114, the bushing is moved forward in the slot 140, overcoming the bias of the compression spring 170, as shown in FIG. 12B.

Changes may be made in the construction, operation and arrangement of the various parts, elements, steps and procedures described herein without departing from the spirit and scope of the invention as described in the following claims.

The invention claimed is:

1. A pipe shuttle comprising:
- a cradle comprising:
  - a pad having a concave and upward-opening surface, and
  - a gripper, pivotal relative to the pad and movable between an open position and a closed position;
- a guide plate positioned adjacent to the cradle;
- a means for translating the cradle relative to the guide plate along a path of travel; and
- at least one roller carried by the gripper and engageable with the guide plate such that the guide plate maintains the gripper in the open position when engaged with the guide plate.

2. The pipe shuttle of claim 1 further comprising a compression spring to bias the gripper to the closed position.

3. A drilling machine comprising:
- a carriage;
- a pipe box; and
- the pipe shuttle of claim 1;
- in which the path of travel of the cradle extends from adjacent the pipe box to adjacent the carriage.

4. The drilling machine of claim 3 further comprising a plurality of pipe sections, in which each pipe section is conformingly received within the base.

5. The drilling machine of claim 4 in which the gripper is adapted to conformingly engage a pipe received within the concave and upward-opening surface of the pad.

6. The pipe shuttle of claim 1 in which the means for translating the cradle comprises a rack and pinion.

7. The pipe shuttle of claim 1 in which the guide plate is a channel-shaped structure and wherein the pipe shuttle further comprises:
- shuttle arms, wherein the cradle is disposed at an end of the shuttle arms; and
- wherein the shuttle arms are configured to be received within the channel-shaped structure.

8. The pipe shuttle of claim 1 wherein the shuttle comprises a shuttle arm, upon which the cradle is disposed, the shuttle arm defining a slot, the pipe shuttle further comprising:
- a bushing disposed through the slot and the gripper arm; and
- a roller disposed about the bushing;
- in which the actuator is attached to the bushing; and
- in which the roller is configured to rollingly engage the guide plate in response to relative motion between the guide plate and the shuttle arm.

9. The pipe shuttle of claim 1 in which the gripper and the pad are in opposed relationship when the gripper is in the closed position.

10. A drilling machine comprising:
- a machine frame;
- a pipe box supported on the machine frame and containing a plurality of pipe sections;
- a carriage movable along the machine frame in a first direction and connectable to each of the plurality of pipe sections; and
- a pipe shuttle comprising:
  - a guide plate fixed in position relative to the machine frame;
  - a support frame supported by the guide plate and movable relative thereto in a second direction;
  - a pad having an upwardly-facing surface configured to conform to an external surface of a pipe; and
  - a gripper disposed on the support frame and movable between an open position and a closed position, and configured to conform to a pipe section held by the support frame when in the closed position, wherein the gripper is pivotal relative to the pad;
  - a roller carried by the gripper and engagable with the guide plate, in which the gripper is maintained in the open position when the roller engages the guide plate.

11. The drilling machine of claim 10 in which the second direction is transverse the first direction.

12. The drilling machine of claim 10 further comprising an actuator configured to bias the gripper toward the closed position.

13. The drilling machine of claim 10 wherein the support frame comprises a slot and further comprising:

a bushing disposed through the slot and the gripper; and a roller disposed about the bushing;

in which the actuator is attached to the bushing; and in which the roller is configured to rollingly engage the guide plate in response to relative motion between the guide plate and the machine frame.

14. A pipe shuttle comprising:

a linear shuttle track;

a shuttle body supported by the shuttle track and constrained to move therealong, the shuttle body having a slot formed therein;

a shuttle drive system configured to power movement of the shuttle body;

a gripper rotatably supported by the shuttle body and conformable to a pipe; and a cam-follower arrangement comprising a bushing disposed against the slot, in which the cam-follower arrangement is configured to cause rotation of the gripper in response to linear motion of the shuttle body.

15. The pipe shuttle of claim 14 in which the cam-follower arrangement does not function on a portion of the shuttle track.

16. The pipe shuttle of claim 14 in which the shuttle body is movable along the shuttle track in a first linear direction and an opposed second linear direction, in which the gripper is rotatable in a first rotational direction and an opposed second rotational direction, in which the cam-follower arrangement is capable of producing rotation of the gripper in the first rotational direction only when the shuttle body moves along the shuttle track in the first linear direction, and in which the cam-follower arrangement is capable of producing rotation of the gripper in the second rotational direction only when the shuttle body moves along the shuttle track in the second linear direction.

17. The pipe shuttle of claim 14, further comprising a biasing spring having one end attached to the shuttle body and an opposed end attached to the gripper.

18. The pipe shuttle of claim 14 in which the shuttle body further comprises a base conformable to a pipe, in opposed and independent relationship to the gripper.

19. A drilling machine, comprising:

a linear carriage track;

a carriage supported by the carriage track, constrained to move therealong, and configured to carry one end of a pipe;

a carriage drive system configured to power movement of the carriage;

a pipe box within which pipes are receivable and from which pipes are removable; and the pipe shuttle of claim 14 in which the shuttle track extends between the pipe box and the carriage track, in transverse relation to the carriage track.

20. A pipe gripper comprising: a first member having an upwardly-facing concave surface; a second member pivotal relative to the first member and movable from a first position to a second position, wherein the second member is configured to contact a pipe being held in the upwardly-facing concave surface when in the first position; a frame supporting the first member and the second member; and a guide plate along which the frame is translated; in which the guide plate engages a roller carried by the second member along a portion of its range of translation and engagement with the guide plate moves the second member from the first position to the second position.

21. The pipe gripper of claim 20 in which the guide plate is characterized as a first guide plate and further comprising:

a second guide plate along which the frame is translated, the second guide plate situated on an opposite side of the frame from the first guide plate; and a third member movable from a first position to a second position, wherein the third member is configured to contact a pipe being held in the upwardly-facing concave surface when in the first position;

in which the second guide plate engages the third member along a portion of its range of translation and engagement with the second guide plate moves the third member from the first position to the second position.

22. A drilling machine comprising:

a drilling machine frame;

a carriage movable on the frame in a first direction;

a pipe box configured to hold a plurality of pipe sections; and the pipe gripper of claim 20;

in which the frame of the pipe gripper is movable on the drilling machine frame in a second direction from a position beneath the pipe box to a position adjacent the carriage.

23. The pipe gripper of claim 20 in which the first member is biased to grip a pipe when the second member is in the first position.

24. The pipe gripper of claim 23 in which the first member is biased by a spring.

* * * * *